United States Patent [19]

Sidi et al.

[11] Patent Number: 5,010,210

[45] Date of Patent: Apr. 23, 1991

[54] TELECOMMUNICATIONS CABLE

[75] Inventors: Shiraz I. Sidi, Pointe Claire; Paul A. Guilbert, LaSalle; Lise A. Desroches, Boisbriand; Michel Plasse, Lachine, all of Canada

[73] Assignee: Northern Telecom Limited, Montreal, Canada

[21] Appl. No.: 541,646

[22] Filed: Jun. 21, 1990

[51] Int. Cl.[5] ..... H01B 11/02

[52] U.S. Cl. ..... 174/34; 174/113 R; 174/121 A

[58] Field of Search ..... 174/34, 113 R, 121 A

[56] References Cited

U.S. PATENT DOCUMENTS

| | | | |
|---|---|---|---|
| 3,006,787 | 10/1961 | Blewis et al. | 428/379 |
| 3,433,890 | 3/1969 | Gabriel et al. | 174/116 |
| 3,571,490 | 3/1971 | Bunish et al. | 174/113 R |
| 4,012,577 | 3/1977 | Lang et al. | 174/34 X |
| 4,370,076 | 1/1983 | Sullivan et al. | 174/110 PM X |
| 4,408,443 | 10/1983 | Brown et al. | 174/34 X |
| 4,500,748 | 2/1985 | Klein | 174/121 A |
| 4,697,051 | 9/1987 | Beggs et al. | 174/34 X |
| 4,873,393 | 10/1989 | Friesen et al. | 174/34 |
| 4,969,706 | 11/1990 | Hardin et al. | 174/121 A |

*Primary Examiner*—Morris H. Nimmo
*Attorney, Agent, or Firm*—R. J. Austin

[57] ABSTRACT

An unshielded telecommunications cable with a nominal characteristic impedance of 100 ohms and a core with a maximum of six pairs of individually insulating conductor wires. The wire insulation is a flame retardant polyolefin base compound and the conductors of each pair are twisted together with a maximum twist lay of 2.3 inches. The core is surrounded by a flame retardant jacket.

3 Claims, 2 Drawing Sheets

TELECOMMUNICATIONS CABLE

This invention relates to telecommunications cable.

In the telecommunications cable industry, specific designs of cable have conventionally been used for inside buildings. A conventional cable design, which has been employed for voice frequency ranges and low speed data, e.g., up to about 4 or 4.5 megabits, is an unshielded cable having up to six pairs of individually insulated conductors surrounded by a jacket, and wherein the material of the jacket and also of the conductor insulation is a polyvinyl chloride base compound. By unshielded cable throughout this specification is meant a cable which has no metallic sheath between the core and the jacket. In such a cable, the conductors of each conductor pair are twisted together with a twist length, referred to as "twist lay", of between 3.70 and 5.70 inches. While the above design of cable operates satisfactorily within the voice frequency range, it is being found to be unsatisfactory for various reasons above this range, and has limitations for use with digital systems and local area networks. In particular, attenuation of signals at around 16 megabits is undesirably high as is the amount of crosstalk experienced. There is also a high signal distortion in the high frequency ranges used for digital systems. Further to this, at 4 megabits, for digital use, the practical use of the above cable is limited to a certain "reach", i.e., a length of about 750 feet of cable between two computers; this length decreases to about 300 feet at 16 megabits for one link. The reach is decreased further as the number of computers connected within a network is increased. The practical limit with 100 computers is 150 feet at 16 megabits.

The above problems inherent in use of the conventional unshielded cable have been known since the advent of digital systems and much consideration has been given to enabling this cable to be used without its limitations for digital as well as voice frequency use. As a recent example of this, in Oct. 1989, McGraw Hill Inc., a respected authority in the telecommunications industry, issued in its "Datapro Reports on PC Communications", Vol. 5, No. 10, on page 3, an article under "Industry Trends", entitled "U-B and Proteon Break the 16 Mbps/UTP Barrier". This article disclosed that Ungermann-Bass (U-B) and Proteon had stated that they could use unshielded twisted pair wiring for transmitting 16 megabits on the token ring LAN system. Although skeptics have believed that standard telephone wiring could not be used at 16 megabits token ring systems, U-B and Proteon had showed (according to this article) that using suitable electronics in a system hub or by using a suitable filter, the standard wiring could be used in the required manner. Thus, in Oct. 1989, no suitable unshielded conducted pair cable had been devised to operate in a commercially satisfactory manner up to at least 16 megabits and, to overcome the longstanding problem, special electronics or filters had to be designed. In fact, above 4 megabits usage, the only satisfactory cable to date has been a shielded cable which, because of the shielding, avoids high frequency problems found in use of the conventional unshielded cable.

The present invention seeks to provide an unshielded telecommunications cable which minimizes the degree of attenuation and crosstalk while providing a maximized "reach" up to at least 16 megabits.

Accordingly, the present invention provides an unshielded telecommunications cable having a nominal characteristic impedance of 100 ohms and a core comprising a maximum of 6 pairs of individually insulated conductor wires, the wire insulation formed from a flame retardant polyolefin base compound and with the insulated conductors of each pair twisted together with a maximum twist lay of 2.3 inches and the core surrounded by a flame retardant jacket.

In the cable structure according to the invention, the polyolefin insulation provides a low dielectric constant, and a low dissipation factor which is found to be suitable for providing acceptable low attenuation up to about 16 megabits. In addition, the small twist lay minimizes crosstalk at the above voice frequencies for digital transmission but also provides a surprising and unexpected result at those higher frequencies. This surprising result is that below 2.30 inches twist lay, the electrical characteristics are such that electromagnetic interference is reduced to a commercially acceptable level, even though the cable is unshielded. Indeed, the inventive cable has an electromagnetic interference level which meets the EMI requirements per FCC, Part 15, Subpart J. This surprising result enables the inventive cable to be used successfully both for the voice frequency range and for data frequency ranges up to at least 16 megabits.

In addition, it has been found that the cables constructed according to the invention have an extensive reach which is completely acceptable for commercial use, this reach varying for a four-pair conductor cable of 24 AWG conductors, from about 990 feet at 4 megabit rate to approximately 525 feet at the 16 megabit rate. In addition, the near-end crosstalk is minimized to a commercially acceptable level and the cable is capable of producing a high digital performance. (Worst case signal to noise is 12 dB at the highest frequency.) This is as measured upon an oscilloscope for a set number of passes across the screen for a certain length of cable.

In cable structures according to the invention, the maximum twist lay of 2.3 inches may be in a single direction in the core or may oscillate from one direction to another around the core, i.e., in the manner commonly referred to as the 'S-Z' twist.

One embodiment of the invention may be described by way of example with reference to the accompanying drawings, in which.

Figure 1:
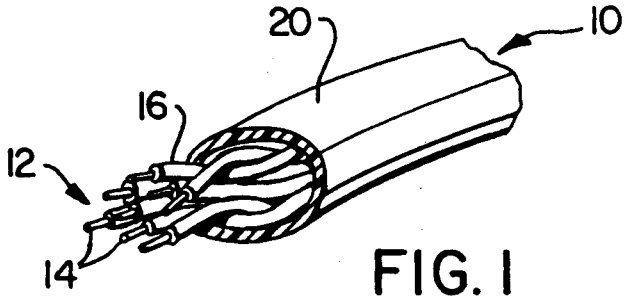
FIG. 1 is an isometric view of part of a cable according to the embodiment.

In the embodiment as shown in FIG. 1, an unshielded inside building telecommunications cable 10 having a nominal characteristic impedance of 100 ohms comprises a core 12 formed from four pairs of individually insulated conductors 14, the conductors in each pair being twisted together with a twist lay not exceeding 2.30 inches. In this particular embodiment, the twist lay is in the range 1.00 to 2.00 inches. The twist lay is in one direction only, but could, alternatively, change direction at specific intervals to provide what is commonly referred to as 'S-Z' twist.

The insulation 16 surrounding each of the conductors 14 is formed from a flame retardant polyolefin base compound, which, for flame retardancy requirements, is suitable for a non-plenum rated cable. This particular compound has a maximum dielectric constant of 2.5 at 1 MHz with the following formulation:

| Material | % Total Wt |
|---|---|
| Base resin polyolefin | 40–65 |
| Halogenated flame retardant | 25–40 |
| Antimony trioxide | 10–20 |
| Stabilizer and lubricants | 0.5–0.2 |

Any formulation according to the above will meet electrical requirements and also Underwriters' Laboratory 1666 Flammability Tests on two pair and higher construction.

In the above typical formulation, the base resin polyolefin may be any suitable polyolefin material such as high or low density polyethylene or an EVA or EEA copolymer or compounds thereof. The halogenated flame retardant material may be decabromodiphenyloxide, or ethylenebistetrabromo-phthalimide, or ethylenebisdibromonorbornane dicarboximide. In addition, the stabilizer may, for instance, be a phenolic or phosphite base antioxidant and the lubricant may be a polyethylene wax.

The core 12 is surrounded by a jacket 20 of a flame retardant material which in this case is a polyvinyl chloride compound. The jacket could, however, be formed from another suitable flame retardant material such as a flame retardant polyolefin compound, a vinyl base compound, or a fluoropolymer compound, e.g., a polytetraflorethyline base compound or a polyvinyledene-fluoride base compound.

Two cables were constructed according to the embodiment. Cable 1 made according to the embodiment had 24 AWG insulated conductors within the core, and Cable 2 differed from Cable 1 solely in that the conductors were of 22 AWG.

A series of tests were conducted to compare certain electrical and other properties of Cables 1 and 2 with a conventional unshielded inside building cable having a nominal characteristic impedance of 100 ohms and having four pairs of individually insulated conductors of 24 AWG. In this standard cable, referred to as Cable 3 in the tests, the twist lay of each pair was above 3.5 inches with the insulation on each pair being formed from a polyvinyl chloride compound. The core comprising the four pairs of conductors in Cable 3 was surrounded by a jacket comprising a polyvinyl chloride base compound. In addition, for various of the tests, a Cable 4 was included. This cable was a standard shielded cable having a core formed from four twisted pairs of conductors of 22 AWG and, of course, having a metal shield between the insulated conductors of the core and the jacket material. Cable 4 had a nominal characteristic impedance of 150 ohms.

Figure 2:
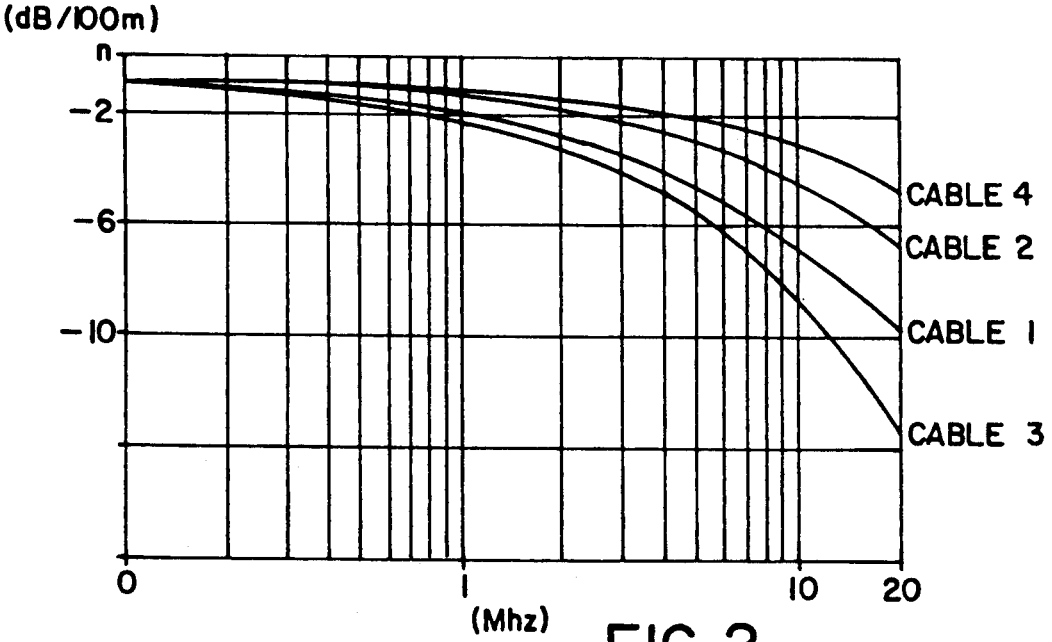
FIG. 2 is a graph which compares attenuation characteristics of prior art cables and cables according to the embodiment.

As may be seen from FIG. 2, the attenuation characteristics of the various cables were compared. This comparison was made over a range from 0 to 20 MHz for one hundred meters of each cable. As may be seen from FIG. 2, the standard cable with the 24 AWG conductors, i.e., Cable 3, had an attenuation characteristic which increased up to slightly below 15 dB/100 meters at 20 MHz whereas the standard Cable 4, the shielded cable operating at a nominal characteristic impedance of 150 ohms, had an attenuation at 20 MHz of about 5 dB/100 meters.

In comparison, Cable 1 constructed according to the embodiment and with 24 gauge conductors, had an attenuation of slightly below 10 dB/100 meters at 20 MHz while the 22 gauge cable of the embodiment (Cable 2) had an attenuation of approximately 7 dB/100 meters.

It is clear from these attenuation results that Cable 1 of the embodiment has a distinct attenuation advantage over standard Cable 3 at 20 megabits which is above the range normally expected for use with data processing at this time. It is also noticeable that the 22 gauge unshielded cable of the embodiment (Cable 2) is comparable for its losses with the standard shielded cable (Cable 4), even though this has the added advantage of the 150 nominal characteristic impedance.

The attenuation results shown by FIG. 2 indicate that the embodiment with regard to Cables 1 and 2 provides acceptable losses while approaching the low losses available with the use of the 150 nominal characteristic impedance Cable 4. Hence the cables of the invention which are directly comparable with Cables 3 and 4 show a distinct advantage at least for attenuation over the standard Cable 3 and enable the embodiment to be used with acceptable attenuation up to 20 MHz or even higher frequencies.

In a further test, Cables 1 and 2 were compared with standard cables 3 and 4 for near-end crosstalk.

Figure 3:
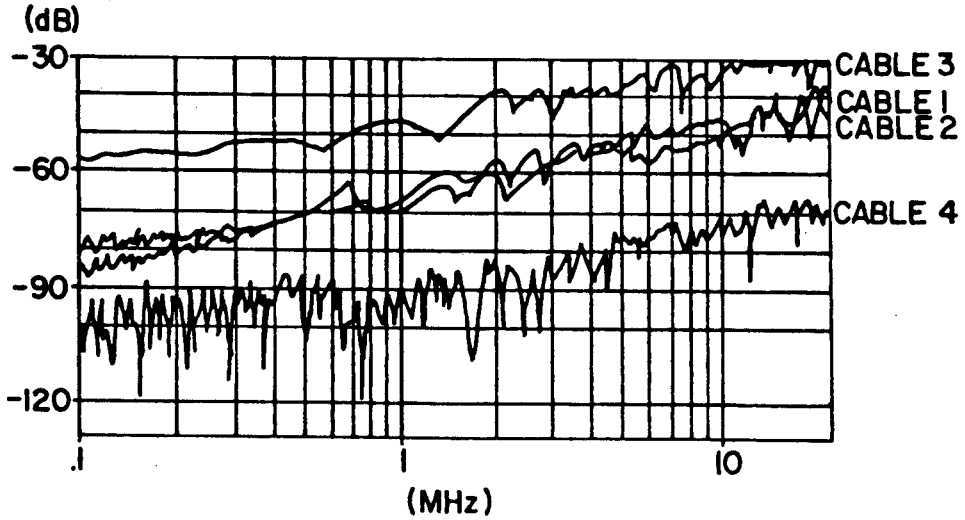
FIG. 3 is a graph comparing near-end crosstalk characteristics of prior art cables and cables according to the embodiment.

The results of this may be seen from FIG. 3 in which Cables 1 and 2 have directly comparable characteristics while having a distinct crosstalk isolation advantage over Cable 3 between 0 and 20 MHz. At the 20 MHz range, there is a 33% crosstalk isolation improvement in Cables 1 and 2 over Cable 3. Cable 4 has a further 15 dB advantage over both of Cables 1 and 2 by virtue of individual pair shielding. The reason for the improvement of Cables 1 and 2 over Cable 3 in this respect is the small twist lay below 2.30 inches in Cables 1 and 2 which, in this embodiment, is approximately 2.00 inches.

Figure 4:
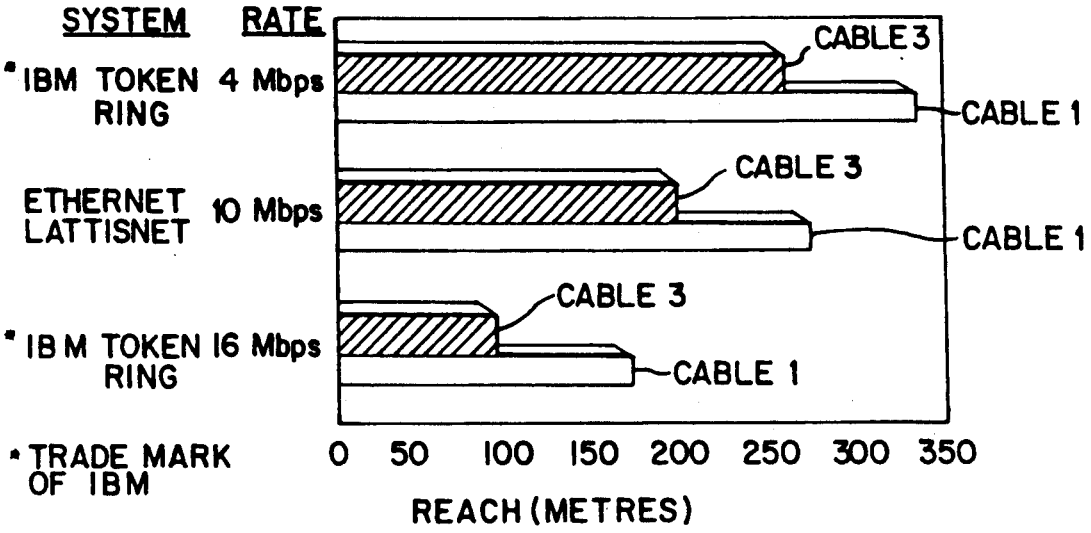
FIG. 4 is a graph comparing the reach of a prior art cable with a cable according to the embodiment.

It was also found that with the unshielded cables, Cables 1 and 2 had a far greater reach than Cable 3. FIG. 4 illustrates this particular point in which the reach of Cable 3 is compared directly with that of Cable 1 at different frequencies. For instance, as shown in FIG. 4, at 4 megabits, whereas Cable 3 had a reach of approximately 770 feet, Cable 1 had a reach of approximately 990 feet for an improvement over Cable 3 of approximately 30%. The reach of both of the cables dropped as the frequency increased until, at 16 megabits, Cable 3 had a reach of approximately 300 feet while Cable 1 had a reach of approximately 525 feet which is an improvement of approximately 70% over Cable 3. In the results of FIG. 4, those for the 4 and 16 megabits were obtained using the IBM Token Ring System, whereas the results at the 10 megabits frequency were obtained with the Ethernet Lattisnet System. At 10 megabits, Cable 3 had a reach of approximately 600 feet, whereas the reach of Cable 1 was approximately 825 feet.

Figure 5:
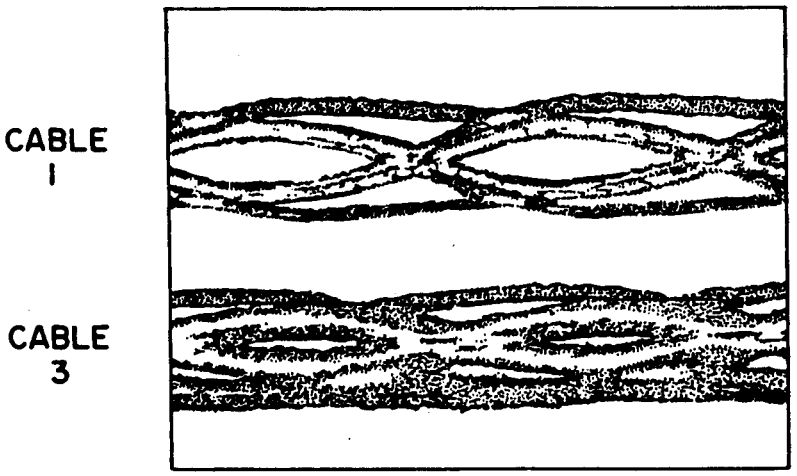
FIG. 5 is a representation of an eye pattern developed through a set number of passes across an oscilloscope screen for a certain length of prior art cable and compared with the pattern for a cable according to the embodiment.

As shown by FIG. 5, signal degradation along Cable 1 was compared with that for Cable 3 for 500 feet of cable using the Ethernet Lattisnet System at 10 megabits. The curves for each cable were produced upon an oscilloscope for 700 passes across the screen for a certain length of cable, each oscillate trace being a function of the encoding technique which, in this case, is the known Manchester encoding technique. The curve structure produced for each cable is referred to as an "eye pattern" which is the result of superimposing all possible pulse sequences during a defined period of time. For the transmission to be error free then each eye formed by a curve should be completely open. As may be seen from FIG. 5, the eye pattern of the curve for Cable 1 is extremely open compared to that for Cable 3, thereby indicating that the signal trace varied extremely little in the case of Cable 1 whereas greater variation was apparent for Cable 3. A conclusion which can be drawn from this is that the degradation of the signal over the length of Cable 1 was far less than was found with Cable 3.

Further to the above comparisons between cables which show clearly that the cables according to the embodiment are superior to Cable 3, it has also been found rather surprisingly, that the cables according to the embodiment have an electromagnetic interference level which meets the EMI requirements per FCC, Part 15, Subpart J. As a result, cables of the embodiment may be used successfully up to at least 16 megabit range.

We claim:

1. An unshielded telecommunications cable having a nominal characteristic impedance of 100 ohms and a core comprising a maximum of six pairs of individually insulated conductor wires, the wire insulation formed from a flame retardant polyolefin base compound and with the insulated conductors of each pair twisted together with the maximum twist lay of 2.3 inches and the core surrounded by a flame retardant jacket.

2. A cable according to claim 1 wherein the twist lay extends in one direction only around the core of the cable.

3. A cable according to claim 1 wherein the polyolefin-base compound comprises a base resin polyolefin in an amount of 40 to 65%, a halogenated flame retardant material in the range between 25 to 40%, antimony trioxide in the range from 10 to 20%, and stabilizer and lubricants in the range from 0.5 to 0.2%, all percentages being by weight of the total weight of the compound.

* * * * *